United States Patent [19]

Daane

[11] 4,265,384

[45] May 5, 1981

[54] AIR BAR HAVING ASYMMETRICAL INLET

[75] Inventor: Robert A. Daane, Green Bay, Wis.

[73] Assignee: W.R. Grace & Co., New York, N.Y.

[21] Appl. No.: 113,804

[22] Filed: Jan. 21, 1980

[51] Int. Cl.[3] ..... B65H 17/32

[52] U.S. Cl. ..... 226/97

[58] Field of Search ..... 226/95, 97, 7; 34/57 R, 34/57 A, 156; 271/90, 309

[56] References Cited

U.S. PATENT DOCUMENTS

| | | | |
|---|---|---|---|
| 3,549,070 | 12/1970 | Frost et al. | 226/97 |
| 3,776,440 | 12/1973 | Frost et al. | 226/97 |
| 3,873,013 | 3/1975 | Stibbe | 226/97 |
| 3,964,656 | 6/1976 | Hella | 226/97 |
| 4,058,244 | 11/1977 | Vits | 226/97 |
| 4,197,971 | 4/1980 | Stibbe | 226/97 |
| 4,197,973 | 4/1980 | Daane | 226/97 |
| 4,201,323 | 5/1980 | Stibbe et al. | 226/97 |

*Primary Examiner*—Leonard D. Christian
*Attorney, Agent, or Firm*—James E. Nilles

[57] ABSTRACT

An elongated air bar having parallel, forwardly opening outlets extending along its length, has partition means in its interior, disposed symmetrically to a plane which is midway between said outlets and extends forwardly and rearwardly through the air bar. The partition means divides the air bar interior into a T-shaped flow distributing compartment and a U-shaped inlet compartment that embraces the stem portion of the flow-distributing compartment. The stem portion of the flow distributing compartment projects rearwardly in the air bar, and pressure air enters that compartment, from the inlet compartment, through port means at its rear, extending all along the air bar. Extremities of the cross-bar portion of the flow-distributing compartment are rearwardly in line with the respective outlets. Like streams of air issue from both outlets, even though pressure air is introduced into the air bar asymmetrically to said plane.

4 Claims, 5 Drawing Figures

AIR BAR HAVING ASYMMETRICAL INLET

FIELD OF THE INVENTION

This invention relates to an elongated air bar which is positioned to extend across the width of a running web and which has a pair of outlet slots that extend along its length and are spaced apart in the direction of web travel, from each of which outlet slots an air stream is directed against a surface of the web to floatingly support the web and/or to effect drying of ink or the like on its surface; and the invention is more particularly concerned with flow distributing means in such an air bar whereby air is caused to issue from the two outlet slots in substantially identical streams that have a desired direction of flow and are of uniform velocity along the length of each slot, even though pressure air is introduced into the interior of the air bar in a markedly asymmetrical relation to the slots.

BACKGROUND OF THE PRIOR ART

Air bars of the general type to which this invention relates are disclosed in U.S. Pat. No. 3,549,070, issued Dec. 22, 1970 to Frost et al; U.S. Pat. No. 3,873,013, issued Mar. 15, 1975 to P. H. Stibbe; U.S. Pat. No. 3,776,440, issued Dec. 4, 1973 to Frost et al; U.S. Pat. No. 3,964,656, issued June 22, 1976 to T. A. Hella; the application of R. A. Daane, Ser. No. 950,745, filed Oct. 12, 1978 (now U.S. Pat. No. 4,197,973 issued Apr. 15, 1980) and the application of P. H. Stibbe, Ser. No. 950,746, filed Oct. 12, 1978 (now U.S. Pat. No. 4,197,971 issued Apr. 15, 1980), all of which have a common assignee herewith.

As brought out in these prior disclosures, such air bars are usually mounted both above and below a web that is moving through a dryer section of a printing press or the like. The air bars that are above the web direct air down onto its upper surface to dry it. The air bars below the web direct air upwardly against it to floatingly support the web as well as to dry its lower surface. Usually there are several air bars both above and below the web, each oriented to have its length extend across the width of the web. Since every air bar must direct an even, uniform flow of air towards the web, all across its width, all of the air bars, both above and below the web, are usually identical with one another.

A typical air bar has two air outlet slots that open from it in a forward direction—that is, towards the web—and those outlet slots extend all along the length of the air bar, parallel to one another, being spaced apart by a small distance across the air bar. For satisfactory flotation of the web, the air streams issuing from the outlet slots are usually in somewhat convergent relation, but it is important that they be symmetrical to a plane that lies between the outlet slots and extends forwardly from the air bar to the web, normal to the web surfaces. Preferably, too, they should have no component of flow in a direction lengthwise of the slots. In prior air bars, pressure air that was to issue forwardly from these outlet slots usually entered the hollow interior of the air bar at its rear; and although the pressure air inlets were in symmetrical relation to the outlet slots, the air entered those inlets from a header in which its flow direction was transverse to the length of the air bar and thus in asymmetrical relation to the two slots. As a result, much attention had to be given to the provision of means in the interior of the air bar for ensuring that like flows would issue from the two outlet slots.

The above mentioned Hella U.S. Pat. No. 3,964,656 relates to an air bar that had its pressure air inlet at one of its ends, but here again the inflow of pressure air was in symmetrical relation to the outlet slots although markedly asymmetrical to the mid-point in the length of the bar.

There are installations in which, for one reason or another, it is not feasible to introduce pressure air into every air bar from its rear or from one of its ends, and wherein the pressure air must instead be fed into the air bar from one side thereof, in a direction markedly asymmetrical to the outlet slots. Having in mind that it has always been considered somewhat difficult to get like flows out of the two outlet slots when pressure air was brought into an air bar in a flow that was in reasonably symmetrical relation to them, it will be understandable that there was all the more difficulty with a pressure air inflow that came from one side of the plane of symmetry of the outlet slots.

The general object of the present invention is to provide an air bar of the type that has two parallel lengthwise extending air outlet slots opening from its front, which air bar is so arranged that substantially identical air streams issue from the two outlet slots, the air issuing from each slot flows in a direction normal to the length of the slot, and each of said air streams has a desired velocity profile along the length of the outlet slot—and all of this notwithstanding that pressure air may enter the hollow interior of the air bar through an air inlet which is in markedly asymmetrical relation to the plane of symmetry of the two outlet slots and/or the midpoint along the length of the air bar and/or with a flow direction markedly different from that desired in the air streams issuing from the slots.

It is a more specific object of the invention to provide flow distributor means for an air bar of the character described whereby pressure air which enters the interior of the air bar at one or a few locations at one side thereof is so redirected and redistributed that it is caused to emerge in substantially identical, uniform streams from a pair of forwardly opening air outlet slots that extend along the length of the air bar.

Another object of this invention that will be understood to have great practical importance is to provide an air bar having flow distributing means whereby like air flows are caused to issue from both outlet slots of the air bar even though pressure air is fed into the air bar in very asymmetrical relation to those slots, which air bar comprises a substantial number of components common to air bars that have heretofore had substantial commercialization, particularly air bars such as are disclosed in the above-mentioned Hella Pat. No. 3,964,656 and the Stibbe application Ser. No. 950,746.

SUMMARY OF THE INVENTION

In general, the objects of the present invention are achieved in an elongated air bar having a front wall, a rear wall, and opposite side walls extending forwardly from the rear wall and cooperating with the front wall to define elongated outlets that extend parallel to one another along the length of the air bar and are sidewardly spaced apart. The front, rear and side walls can have the same form as corresponding components of prior air bars.

The air bar of the present invention has flow controlling means for causing air to issue from its outlets in like streams, each having a flow direction normal to the length of the slot and a desired velocity distribution along the slot, and this notwithstanding that pressure air is introduced into the hollow interior of the air bar in a markedly asymmetrical relation to the outlets. Said flow controlling means comprises partition means in the interior of the air bar, disposed symmetrically to a plane that lies midway between the outlets and extends in a forward and rearward direction through the air bar. Said partition means is of uniform cross-section all along the length of the air bar and is arranged to define two chambers in the interior of the air bar. One of these chambers is a flow directing chamber which has a rear portion with substantially forwardly extending walls that are spaced apart by a distance substantially less than the distance between said outlets, and has a front portion which is substantially wider than said rear portion and into which said rear portion opens forwardly, said front portion having laterally opposite extremity zones, each of which is communicated with one of said outlets and is rearwardly substantially in line with the outlet with which it is communicated. The other chamber in the interior of the air bar that is defined by the partition means is an inlet chamber which is behind the front portion of the flow directing chamber and a portion of which is behind said rear portion of the flow directing chamber. The inlet chamber has an inlet through which pressure air enters the interior of the air bar and is communicated with the flow-directing chamber through port means at the rear of the flow-directing chamber, arranged symmetrically to said plane and extending along the length of the air bar.

BRIEF DESCRIPTION OF DRAWINGS

In the accompanying drawings, which illustrate what is now regarded as a preferred embodiment of the invention.

DESCRIPTION OF PREFERRED EMBODIMENT OF THE INVENTION

Figure 1:
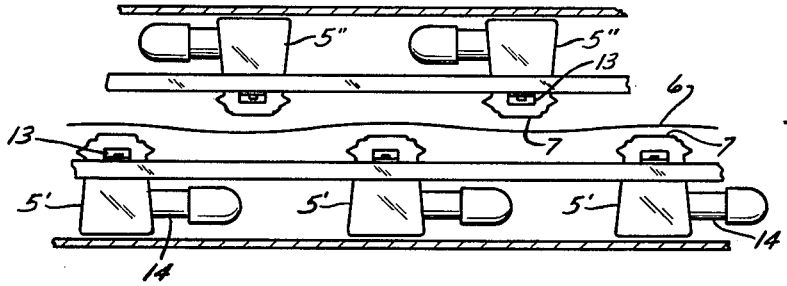
FIG. 1 is a more or less diagrammatic view in side elevation of a dryer section of a web press, comprising a plurality of air bars that embody the principles of this invention.
Figure 2:
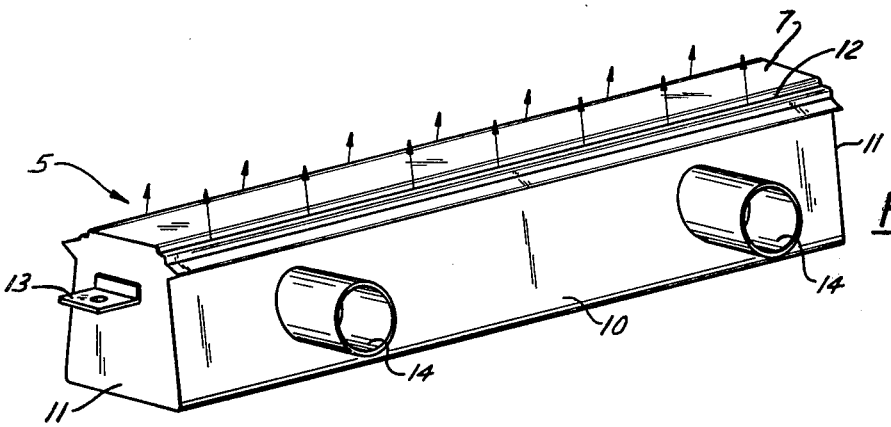
FIG. 2 is a perspective view of one of such air bars, on a larger scale.
Figure 3:
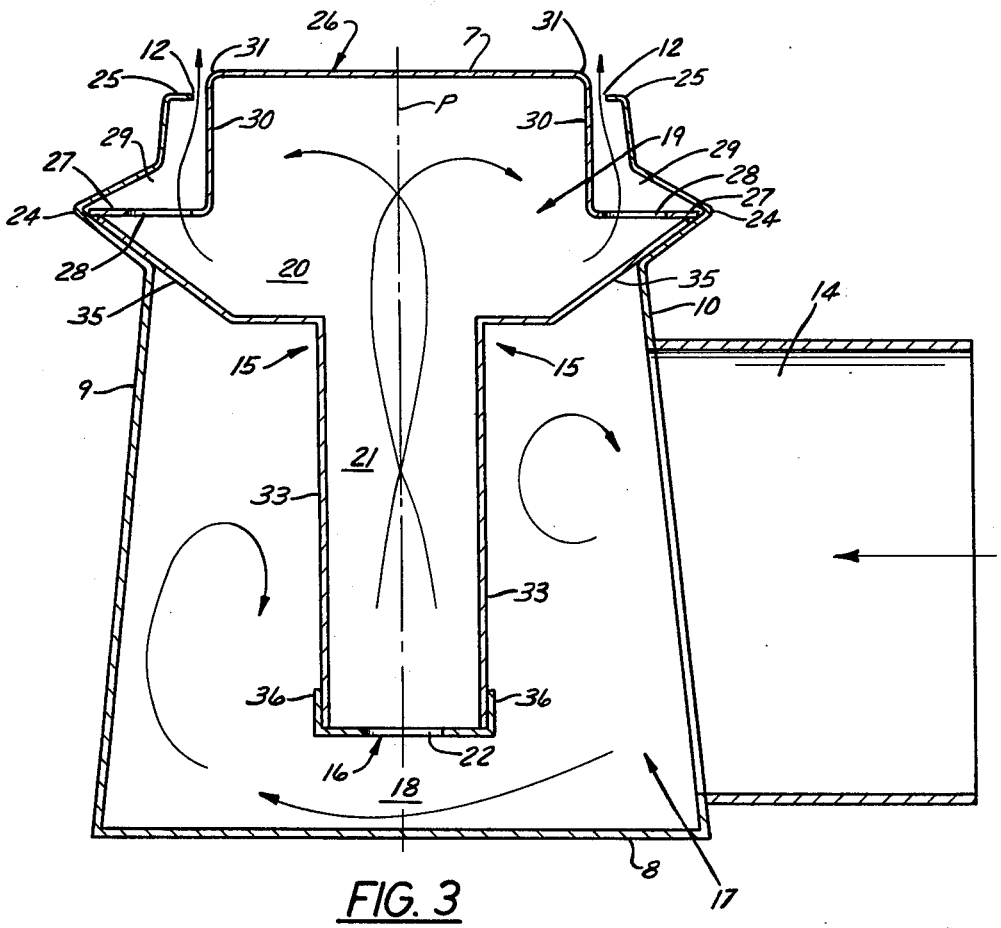
FIG. 3 is a view in cross-section through an air bar of this invention, on a still larger scale.
Figures 4, 5:
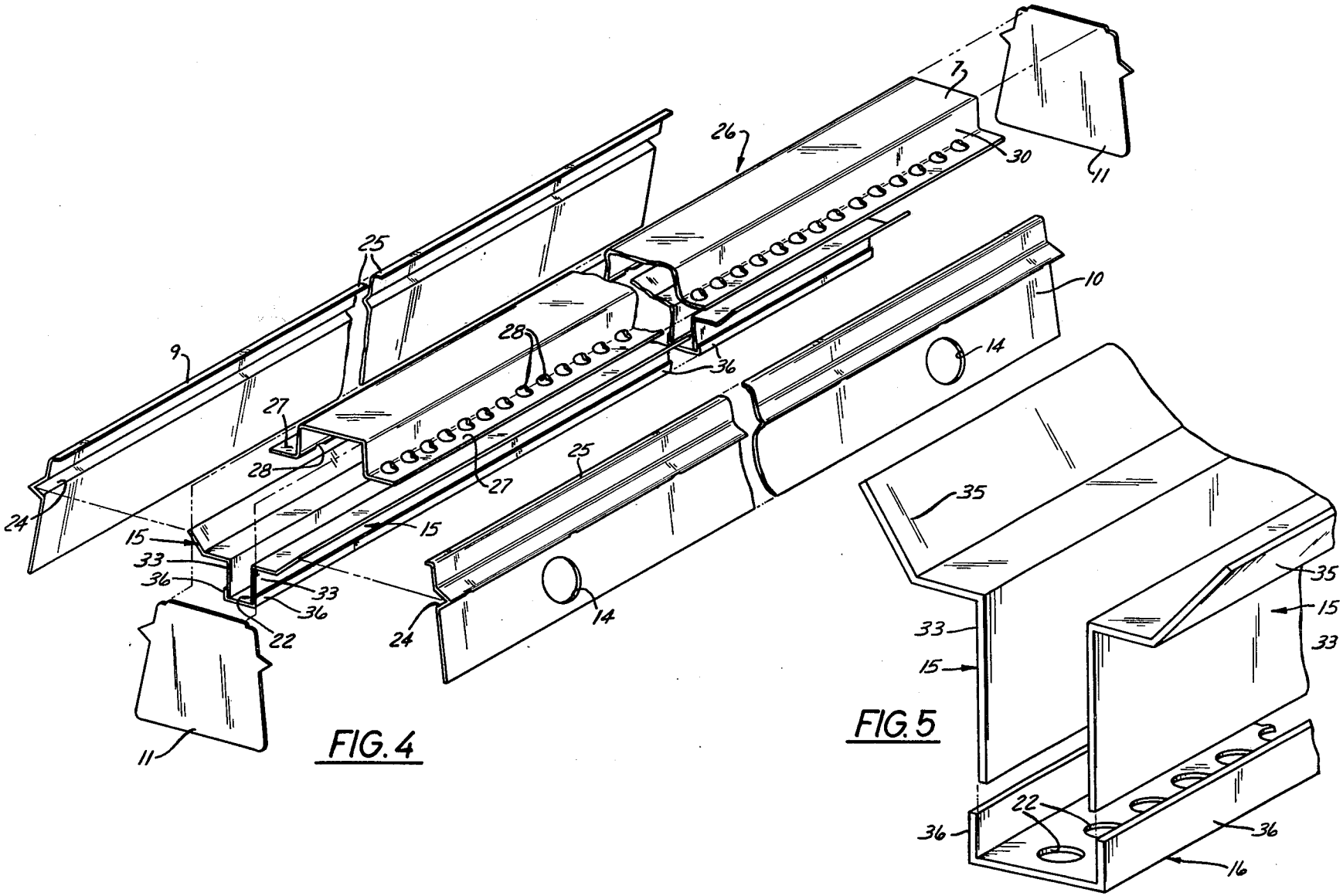
FIG. 4 is a disassembled perspective view of an air bar of this invention.
FIG. 5 is a fragmentary disassembled perspective view, on a larger scale than FIG. 4, showing a part of the air flow distributor means in an air bar of this invention.

Referring now to the accompanying drawings, air bars 5 of the present invention are intended to cooperate with a freshly imprinted or coated web 6 of paper or the like that moves along a defined path. As shown in FIG. 1, one group of air bars 5' of this invention is mounted below the path of the web 6, to blow air upwardly against the web for floatingly supporting it while at the same time drying its bottom surface; and a group of similar air bars 5'' is mounted above the web 6 to blow air down against its top surface, for drying the same.

Each of the air bars 5 is long and narrow. Its length is at least equal to the width of the web 6, and it is mounted with its length extending widthwise of the web. As is generally conventional, the air bar 5 has a hollow interior and comprises a front wall 7 that faces the web 6, a rear wall 8 that is remote from the web, opposite side walls 9, 10 that extend forwardly from the rear wall 8, and opposite end walls 11. The air bar is mounted by means of brackets 13 that project endwise from its end walls 11.

At its front the air bar has a pair of forwardly opening air outlet slots 12, one adjacent to each of the side walls 9, and 10, and each extending along the full length of the air bar. The streams of air that issue from these outlet slots 12 flow forwardly towards the web 6 in slightly convergent relation to one another. Those streams should be identical with one another, and each should have a predetermined velocity profile all along the length of its slot 12, even though in this case pressure air to be delivered from the outlet slots 12 is introduced into the interior of the air bar through its side wall 10, so that the air entering the air bar is flowing in a direction from side to side thereof and transversely to the slots 12.

Further, the flow direction of the air issuing from each outlet slot 12 should be normal to the slot, that is, it should have substantially no component along the slot, even though pressure air is introduced into the air bar at an inlet near one end thereof or with a flow in a direction lengthwise of the air bar.

As shown, the pressure air is brought into the air bar by means of a pair of ducts 14 which open through the side wall 10 at locations that are spaced from one another and from the ends of the air bar. Thus, in order to obtain the required air flows out of the slots 12, it is necessary to effect, inside the air bar, a redistribution of pressure of the incoming pressure air along the length of the air bar and a redirection of the flow of that air so that its flow is symmetrical to the outlet slots 12 as it approaches them.

The air flow distributing means of this invention, by which such redistribution and redirection of the air flow is produced, comprises a pair of side partition elements 15 which cooperate with a rear partition element 16 to divide the interior of the air bar into two chambers. One of these is an inlet chamber 17 that is generally U-shaped in cross-section, with its bight portion 18 at the rear of the air bar; the other is a flow-directing chamber 19 that is substantially T-shaped in cross-section and has its cross-bar portion 20 at the front of the air bar and its stem portion 21 projecting rearwardly. The U-shaped inlet chamber 17 embraces the stem portion 21 of the T-shaped flow-directing chamber, and communication between those two chambers is limited to port means 22 at the rear of the T-shaped flow-directing chamber 19.

It will be observed that the cross-section of the partition means 15, 16 and of the air bar generally, is substantially uniform all along the length of the air bar and is symmetrical to a plane P which extends along the length of the air bar, midway between the outlet slots 12, and which also extends through the front and rear walls 7 and 8 of the air bar. The air streams that issue from the slots 12 are of course symmetrical to the plane P.

Turning now to a more detailed consideration of the construction of the air bar and partition means 15 and 16, each of the side walls 9, 10 of the air bar has bends all along its length that define an inwardly opening groove 24 of V-shaped cross-section that is spaced a small distance behind the front of the air bar. At the front edge of each side wall 9, 10 there is a laterally inturned lip 25 that defines one edge of the outlet slot 12 adjacent to that side wall. The side walls 9, 10 can be formed in one piece with the rear wall 8 and bent forwardly therefrom, or they can be formed as separate elements fastened to the rear wall 8 by weldments or the like.

The front wall 7 of the air bar comprises the web portion of a hat-section channel member 26 that has its laterally outwardly projecting flanges 27 received in the inwardly opening V-grooves 24 in the side walls 9, 10. Apertures 28 in each flange 27, at regular intervals along its length, provide for communication between the T-shaped flow-directing chamber 19 and an outlet chamber 29 behind each outlet slot 12, through which pressure air flows to the outlet slot. Each of the outlet chambers 29 is defined by a leg 30 of the hat-section channel member 26 in cooperation with its adjacent flange 27 of that channel member and the front portion of the adjacent side wall 9, 10. The lip 25 on each side wall 9, 10, which defines one edge of each outlet slot 12, is spaced from the adjacent leg 30 of the hat-section member 26, which defines the other edge of the outlet slot.

Each leg 30 of the hat-section member 26 joins its web portion 7 around a curve that provides a Coanda surface 31. The air stream issuing from each outlet slot 12 has a tendency to follow that Coanda surface for a little distance, and this Coanda effect causes the air streams that issue from the two outlet slots 12 to be somewhat convergent.

It will be apparent that the hat-section member 26 cooperates with the side partition elements 15 to define the T-shaped flow-directing chamber 19, and particularly the front or cross-bar portion 20 thereof.

The rear partition element 16 is spaced forwardly from the rear wall member 8 and extends parallel to it, cooperating with it to define the bight portion 18 of the U-shaped inlet chamber 17. The port means 22 by which the inlet chamber 17 is communicated with the flow-directing chamber 19 comprises a row of holes in the rear partition element 16, spaced from one another along its longitudinally extending centerline and thus centered on the above mentioned plane of symmetry P.

Each of the side partition elements 15 has a rear portion 33 that extends straight forwardly from the rear partition element 16, parallel to the plane P, and has a laterally outwardly projecting portion 35 that extends obliquely forwardly and across to the V-shaped groove 24 in the adjacent outer side wall 9 or 10. The parallel rear portions 33 of these side partition elements cooperate with one another and with the rear partition element 16 to define the stem portion 21 of the T-shaped flow-directing chamber, which in effect comprises a duct that leads forwardly from the port means 22 to the substantially wider front portion 20 of the flow directing chamber. Note that the wall portions 33 are spaced apart by a substantially smaller distance than the distance between the outlets 12 and that these wall portions 33 cooperate with their respectively adjacent outer side walls 9, 10 to define the legs of the U-shaped inlet chamber 17. Forwardly projecting flanges 36 on the rear partition element 16 provide for its connection, as by welding, to the side partition elements 15.

It will now be apparent that pressure air entering the air bar through the inlet ducts 14 undergoes substantial deceleration as it enters the U-shaped inlet chamber 17, inasmuch as the volume of that chamber is relatively large, and consequently there is a substantial equalization of pressure along the length of that chamber 17 and across its width. The only outlet from the inlet chamber 17 is through the port means 22 at the rear of the flow-directing chamber 19. The total cross-section area of the holes comprising said port means 22 is relatively small, and therefore the air is accelerated in passing through those holes and enters the rear portion 21 of the flow-directing chamber 19 with a substantially true forward motion, that is, with little or no sideward component of flow, symmetrically to the plane P. In the rear portion 21 of the flow-directing chamber 19 the air is further guided for straight forward flow by the parallel partition portions 33 between which it flows and which define a relatively narrow flow-straightening channel that leads forwardly from the holes 22. The air emerges into the relatively wide front portion 20 of the flow-directing chamber, where it is further decelerated and diverted sidewardly, symmetrically to the plane P, for flow into the respective outlet chambers 29 through the apertures 28. The symmetrically diverging air flows in the front portion 20 of the flow-directing chamber 19 move to laterally opposite zones at the extremities of that front portion, directly behind the respective flanges 27 of the hat-section member 26, which zones are substantially in rearward alignment with the outlets 12. It will be apparent that the outlet chambers 29 effect a final deceleration of the air after it issues from the apertures 28 and just before it flows out of the slots 12, to ensure that like streams issue from the two outlet slots 12, as is desired.

If it is desired to have air issue from each of the outlet slots 12 at a flow rate that is uniform all along the length of the slot, the holes comprising the port means 22 should be spaced along the rear partition element 16 at uniform intervals all along its length. However, in some cases it is desired to have a slightly higher air flow velocity at each end portion of each of the outlets 12, for better web tracking; and in such cases the holes 22 can be somewhat closer together in the end portions of the air bar. It has been found that the air velocity profile along the length of each outlet 12 tends to correspond quite closely to spacing of the holes 22.

The pressure loss due to the flow distributing means of this invention is on the order of 15 to 20 percent. This loss is somewhat high for ordinary installations presenting no special problems, but it is acceptable for the problem situations for which the invention is particularly intended, namely, those installations in which pressure air must be introduced into the air bar in a flow direction that is substantially asymmetrical to the outlet slots 12 and those installations in which closely equal air streams must issue from the two outlet slots or in which it is very important to maintain a predetermined air velocity profile along the length of each slot.

From the foregoing description taken with the accompanying drawings it will be apparent that this invention provides an air bar having a pair of forwardly opening air outlet slots extending along its length and having simple, inexpensive and effective flow distributing means for causing like air streams to issue from the two outlet slots, each having a predetermined velocity profile along its length.

What is claimed as the invention is:

1. An air bar from which a pair of air streams can issue forwardly to impinge against a surface of a running web, said air bar being elongated to extend in a direction widthwise of the web and having a hollow interior from which a pair of elongated outlets at the front of the air bar open forwardly, said outlets extending along the length of the air bar, parallel to a plane that is midway between them, which plane extends lengthwise of the air bar and in a forward and rearward direction therethrough, said air bar being characterized by:

flow controlling means for causing like streams of air to issue from said outlets even though pressure air is introduced into the hollow interior of the air bar asymmetrically to said plane, said flow controlling means comprising:

A. partition means in the interior of the air bar, disposed symmetrically to said plane and extending along the length of the air bar, said partition means separating the interior of the air bar into two compartments that are of constant cross-section all along the length of the air bar, (1) one of said compartments being a flow-directing chamber that is substantially T-shaped in cross-section and has its cross-bar portion at the front of the air bar and its stem portion projecting towards the rear of the air bar, and (2) the other of said compartments being an inlet chamber that is substantially U-shaped in cross-section and has portions at both sides of the stem portion of the flow-directing chamber and behind the same, B. port means at the rear of the flow-directing chamber, arranged symmetrically to said plane and extending all along the length of the air bar, through which air can flow from the inlet compartment into said flow-directing chamber; and C. said outlets being communicated with the T-shaped flow-directing chamber at the ends of its cross-bar portion.

2. The air bar of claim 1 wherein said partition means comprises substantially flat wall portions that are parallel to said plane and are spaced equal distances to opposite sides thereof, whereby the stem portion of said T-shaped flow-directing chamber is separated from portions of said inlet chamber.

3. The air bar of claim 2 wherein the hollow interior of said air bar is defined by a front wall, an outer rear wall spaced behind said front wall, and outer side walls which extend forwardly from said outer rear wall and which are respectively spaced outwardly from said wall portions of said partition means, further characterized by:

(1) an inner rear wall which is connected with the rear edges of said wall portions and is spaced forwardly from said outer rear wall, and (2) said port means comprising holes in said inner rear wall, spaced along the length thereof and arranged symmetrically to said plane.

4. In an air bar by which a pair of air streams are directed forwardly to impinge against a surface of a running web, said air bar being elongated to extend in a direction widthwise of the web and having a hollow interior from which a pair of sidewardly spaced apart outlets at the front of the air bar open forwardly, said outlets extending along the length of the air bar and being parallel to a plane which lies midway between them and which extends in a forward and rearward direction through the air bar, flow controlling means for causing like streams of air to issue from said outlets even though pressure air is introduced into the hollow interior of the air bar asymmetrically to said plane, said flow controlling means comprising:

partition means in the interior of the air bar, disposed symmetrically to said plane and of uniform cross-section all along the length of the air bar, said partition means being arranged to define in the air bar interior (1) a flow-directing chamber which has (a) a rear portion with substantially forwardly extending walls that are spaced apart by a distance substantially less than the distance between said outlets and including port means and (b) a front portion substantially wider than said rear portion and into which said rear portion opens forwardly, said front portion having laterally opposite extremity zones, each of which is communicated with one of said outlets and is rearwardly substantially in line with the outlet with which it is communicated; and (2) an inlet chamber which is behind said front portion of the flow-directing chamber and a portion of which is behind said rear portion of the flow-directing chamber, said inlet chamber (a) having an inlet through which pressure air enters the interior of the air bar and (b) being communicated with said flow-directing chamber through said port means at the rear of the flow-directing chamber, arranged symmetrically to said plane and extending along the length of the air bar.

* * * * *